US008267618B2

(12) United States Patent
Chen et al.

(10) Patent No.: US 8,267,618 B2
(45) Date of Patent: Sep. 18, 2012

(54) METHOD FOR MANUFACTURING ARTIFICIAL PAVING THAT HELP IMPROVING GLOBAL WARMING

(76) Inventors: Jui-Wen Chen, Shulin (TW); Ting-Hao Chen, Shulin (TW)

( * ) Notice: Subject to any disclaimer, the term of this patent is extended or adjusted under 35 U.S.C. 154(b) by 88 days.

(21) Appl. No.: 12/946,802

(22) Filed: Nov. 15, 2010

(65) Prior Publication Data

US 2012/0063846 A1 Mar. 15, 2012

(30) Foreign Application Priority Data

Sep. 9, 2010 (TW) ..... 99130440 A

(51) Int. Cl.
*E01C 19/00* (2006.01)

(52) U.S. Cl. ..... 404/82; 404/17; 404/27; 404/31

(58) Field of Classification Search ..... 404/17, 404/19–22, 31, 32, 72, 75, 76, 90, 93, 94, 404/101, 111
See application file for complete search history.

(56) References Cited

U.S. PATENT DOCUMENTS 2,148,773 A * 2/1939 Ozias ..... 404/2
2,746,365 A * 5/1956 Darneille ..... 404/2
3,645,177 A * 2/1972 Hargett ..... 404/2
4,411,555 A * 10/1983 Minvielle et al. ..... 405/50
4,797,026 A * 1/1989 Webster ..... 404/28
4,852,319 A * 8/1989 Cowan ..... 52/302.1
5,123,778 A * 6/1992 Bohnhoff ..... 404/28
5,482,399 A * 1/1996 Bright et al. ..... 404/17
6,095,718 A * 8/2000 Bohnhoff ..... 405/52
6,102,613 A * 8/2000 Medico et al. ..... 404/17
6,585,449 B2 * 7/2003 Chen ..... 404/2
6,962,464 B1 * 11/2005 Chen ..... 405/43
7,198,432 B2 * 4/2007 Chen ..... 405/50
7,351,004 B2 * 4/2008 Shaw et al. ..... 404/17
7,938,597 B2 * 5/2011 Blackwood ..... 405/50
8,142,101 B2 * 3/2012 Kaul ..... 404/31

* cited by examiner

*Primary Examiner* — Raymond W Addie
(74) *Attorney, Agent, or Firm* — Leong C. Lei

(57) ABSTRACT

Provided is a method for manufacturing artificial paving that helps improving global warming. A water permeable paving layer is provided under which a drain layer, which includes gravels or sand, is selectively formed, and an interfacing layer is formed under the drain layer. An ecological gradation layer is set and rammed. The underside ecological gradation layer provides an effect of supporting and, due to the ecological gradation layer containing therein hollow bodies, which can be embodied as disaster-prevention water-storage hollow bodies or earth-improvement hollow bodies or microorganism-culture hollow bodies or water-keeping hollow bodies as desired, allows rainwater falling on ground surface to quickly penetrate down into the underground location, makes the ecological gradation layer effectively preserve water in high water content, and prompt breeding of microorganisms, whereby when the atmosphere is of a high temperature, underground humidity can be released through drainpipes that constitute the water permeable paving.

24 Claims, 16 Drawing Sheets

METHOD FOR MANUFACTURING ARTIFICIAL PAVING THAT HELP IMPROVING GLOBAL WARMING

TECHNICAL FIELD OF THE INVENTION

The present invention generally relates to a method for manufacturing artificial paving that help improving global warming, and more particularly to artificial paving that is constituted by an underground ecological gradation layer and an artificial water-permeable surface paving layer, which allows rainwater to be efficiently and effectively conducted into the underground gradation layer to effect storage of rainwater and reduction of surface flooding and also to form an excellent propagation environment in earth of the ecological gradation layer for microbial strains and earth protozoa for biological diversity, thereby helping maintaining soil wet and thus realizing regulation of temperature and humidity of the surrounding and improving quality of earth.

DESCRIPTION OF THE PRIOR ART

Generally, conventional construction of concrete paving is done by pouring a sufficient amount of cement grout on the ground, leveling the cement grout, and then setting brick tiles thereon, to thereby form artificial concrete paving.

The conventional paving according is made of concrete or a combination of concrete and bricks, and concrete is generally water impermeable. Even though the concrete is water permeable one, pores of the concrete are easily blocked. Further, the concrete may generate calcium oxide, which blocks the pores and cannot be removed and cleaned, so that water permeability may get much lower than the precipitation rate. When rainwater is accumulated on the ground, if it cannot be efficiently discharged into the underside soil, flood disasters may result easily due to accumulation of a large amount of precipitation.

In the construction of regular roads or in the urban areas, paving for ground of construction site is often made integrally as a water impermeable surface paving layer. This prevents underside soil from contacting the atmosphere existing above the paving and replenishment of underground water with precipitation is blocked off. This causes damage to the environment. Apparently, such a concrete made paving structure that is water impermeable is not an ideal one. In cities, when it rains, the ground surface lacks of sufficient water permeation and thus most of the rainwater must be drained through unban sewage systems. Rainwater may finally be collected in underground main ducts of the sewage systems to be discharged to seas or oceans. This is just a water of the natural resources of rainwater. Further, the rainwater, once conducted to a low altitude area, may result in flooding disasters.

As the soil has the function of absorbing water, and can vaporize humidity when contacting the atmosphere in a dry or hot environment to generate a heat exchange effect with the atmosphere, and may automatically regulate the humidity so as to avoid the occurrence of heat island effect.

It is known that without efficient water permeability, rainwater drainage on ground surface will become poor. Thus, it is of importance to construct a gradation layer that is effective in maintaining water permeability and preservation of water. Further, to improve earth and ecological environment in earth, an environment that is beneficial to microorganisms and earth protozoa inhabiting in earth. The microorganisms inhabiting in earth generally include bacteria (eubacteria and archaea), fungi (filamentous fungi and yeasts), and algae. The earth protozoa include for example amoeba and ciliates.

There are a huge number of ciliates existing in earth, and they make a great contribution for decomposition of organic substances. Insects, including ants, centipedes, aphids, and mites, help moving soils or digests residual body portions of organisms and thus providing organic substances. Earthworms may help formation of soil pellets, which are good for air ventilation and water draining. Nematodes help digesting organic matters or other small creatures. There are also vertebrates inhabiting in earth, such as mice, which dig and loosen soil, and provide excrements for fertilizing earth. They are also a member of an underground food chain.

Earth microorganisms play an important role in keeping quality of earth. The existence of earth organisms is a vital factor for change and quality of earth environment.

Studies show the importance of microorganisms to earth is as follows:

(1) decomposition of organic substances and performance of mineralization by fully decomposing organic substances to nutrient elements;

(2) fixation of nitrogen ($N_2$) in atmosphere and conversion into $NH_3$, serving as useful resources of nitrogen for organisms;

(3) prompting nitrification, which converts $NH_4^+$ into nitrite nitrogen ($NO_2^-$), and then nitrate nitrogen ($NO_3^-$) for easy absorption by plants;

(4) performing de-nitrification, which converts $NO_3^-$ into $N_2O$ and $N_2$;

(5) prompting dissolution of coupled or fixed chemical compounds of for example phosphorous, sulfur, iron, and manganese; and (6) interaction with other earth microorganisms, which play an important role of the survival of such other microorganisms in the environment.

Thus, constructing a good environment for mass propagation of earth microorganisms is beneficial for improvement of earth. Further, formation of a water preservation gradation layer under an artificial paving layer allows for mutual contact with a top surface of the water permeable paving layer. Through mutual contact between soil and the atmosphere, heat exchange due to humidity and temperature is conducted just like respiration, helping realizing efficient water drainage and eliminating potential risk of surface accumulation of water, thus providing a practical effect.

In view of the above discussed issue, the present invention aims to provide a method for manufacturing artificial paving that helps improving global warming and allows for construction of concrete paving that shows water permeability and environmental protection feature to allow underside gradation layers to become an ecological gradation layer to activate organic substances contained in soil and improve global warming problem.

SUMMARY OF THE INVENTION

Thus, an objective of the present invention is to provide a method for manufacturing artificial paving that helps improving global warming for quickly conducting rainwater falling on ground surface downward into the underground soil, wherein an artificial paving having high water permeability is formed to reduce potential risk of flooding on ground surface, accumulate and store water, and help recycling water resources of precipitation.

Another objective of the present invention is to provide a method for manufacturing artificial paving that helps improving global warming, which converts an underground gradation layer into an ecological gradation layer, which ensure high water content so that when the outside temperature gets high, drainpipes of the artificial paving allow water contained underground to be converted into vapor to be released to the atmosphere in order to regulate surrounding temperature and humidity and thus eliminate or alleviate heat island effect.

A further objective of the present invention is to provide a method for manufacturing artificial paving that helps improving global warming, which comprises an underground ecological gradation layer that uses a water permeable surface paving layer to enhance water absorption thereof and also provide drainpipes capable of water draining and water storage and drainpipes capable of water draining and water condensation under the ground so that through a huge number of drainpipes installed in this way to conduct surface rainwater into the underside gradation layers, allowing water to penetrate down into the underground water stratum, whereby the water permeable artificial paving layer enhances the formation of an excellent environment thereunder for microorganisms and earth protozoa inhabiting in the surrounding earth, and the gradation layer is formed as an ecological gradation layer, so that an effect of improving global warming is realized between earth and atmosphere on ground surface.

To achieve the above objectives, the present invention provides a water permeable artificial paving structure, wherein under a surface paving layer, a drain layer, which comprises gravels or sand, is selectively formed, or alternatively, an interfacing layer is formed under the drain layer. Then, an ecological gradation layer is set and rammed. As such, the underside ecological gradation layer provides an effect of supporting and, due to the ecological gradation layer containing therein hollow bodies, which can be embodied as disaster-prevention water-storage hollow bodies or earth-improvement hollow bodies or microorganism-culture hollow bodies or water-keeping hollow bodies as desired, allows rainwater falling on ground surface to quickly penetrate down into the underground location, makes the ecological gradation layer effectively preserve water in high water content, and prompt breeding of microorganisms, whereby when the atmosphere is of a high temperature, underground humidity can be released through drainpipes that constitute the water permeable paving to thereby provide an effective method for improving environment warming. The water permeable paving may comprise a framework into which cement grout is poured to form a plurality of drainpipes that function to drain water, and can alternatively formed as a water impermeable paving structure with concrete having a rigid paving surface in which a plurality of drain holes is formed with the use of hole drilling tools for receiving and retaining therein a plurality of condensation pipes capable of water draining and air storage and/or water storage pipes capable of water draining and water storage to be fit therein so as to similarly construct an artificial paving structure that helps improving global warming.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
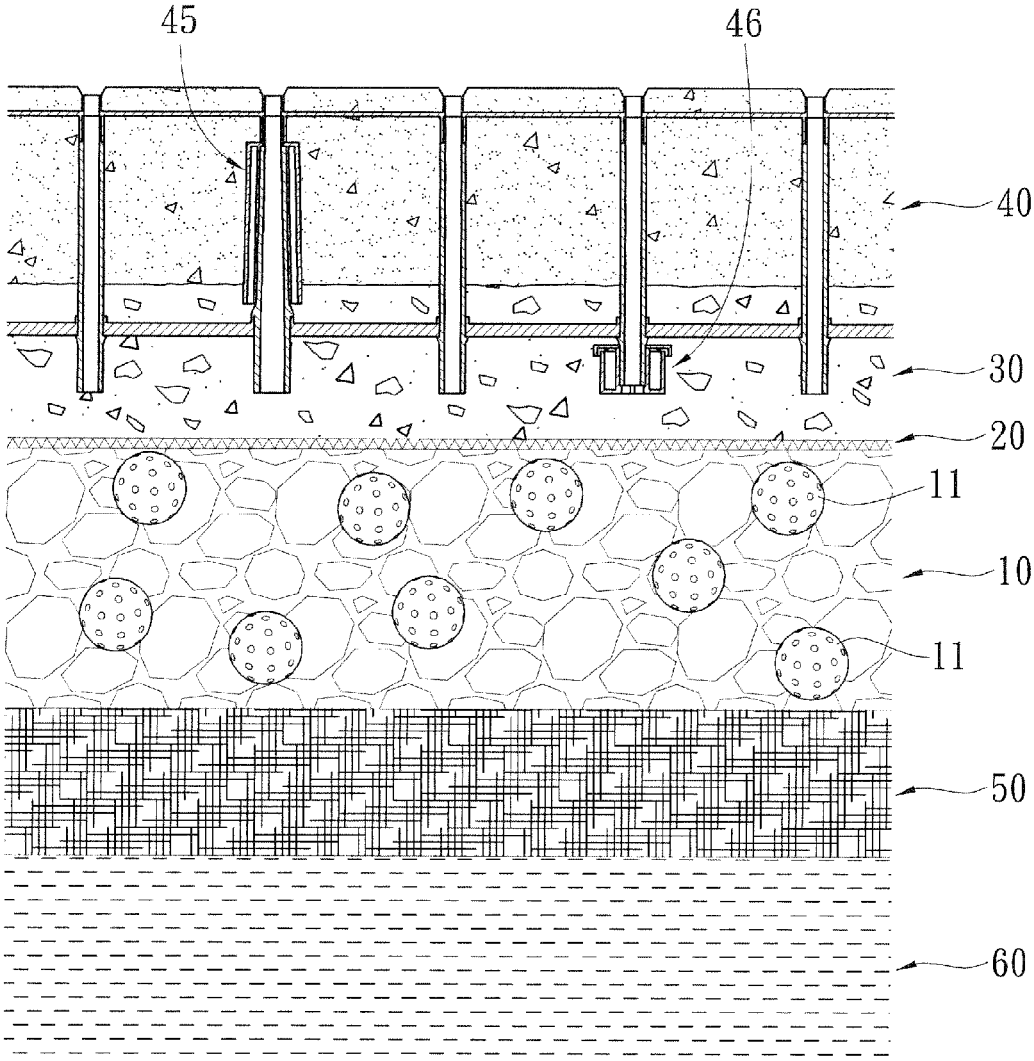
FIG. 1 is a schematic view showing an artificial geological layer constructed in accordance with the present invention.

Referring to FIG. 1, the present invention provides a method for manufacturing artificial paving that help improving global warming, which comprises, after leveling of ground surface, laying an ecological gradation layer 10. The ecological gradation layer 10 may be on-site earth and/or gradation material commonly used for road construction, including aggregates, soils, gravels, a mixture of water-permeable concrete, and additionally and of importance, comprising unique hollow bodies 11. All the constituent components are mixed and laid on the bottom, and then, after pressurization for ramming, an interfacing layer 20 is selectively and additionally set thereon. The interfacing layer 20 may comprise a piece of non-woven fabric or a net, or a layer of sand. Atop the interfacing layer 20, a drain layer 30 is set. The drain layer is composed of gravels (or crushed stones) or sand or a combination of both. Finally, a water permeable paving layer 40 is set on the drain layer 30. With such an arrangement, rainwater that drops to the ground surface can be allowed to permeate all the ground layers artificially set above to penetrate to an underground water stratum 60 under an underground soil stratum 50, whereby rainwater can be conducted to the underground water stratum 60 deeply under the earth to serve as supplemental underground resources and also, the gradation layers can be modified to serve as an ecological gradation layer 10, which when used in combination with the water permeable paving layer 40, provides versatile functions and also form an excellent survival environment for soil microorganisms and earth protozoa.

The interfacing layer 20 and the drain layer 30 can be used individually or in combination. Alternatively, the water permeable paving layer 40 is directly set atop the ecological gradation layer 10, and the interfacing layer 20 and the drain layer 30 are selectively added according to actual water drainage of the construction site to realize similar effects of water draining and protection against global warming.

Figure 2:
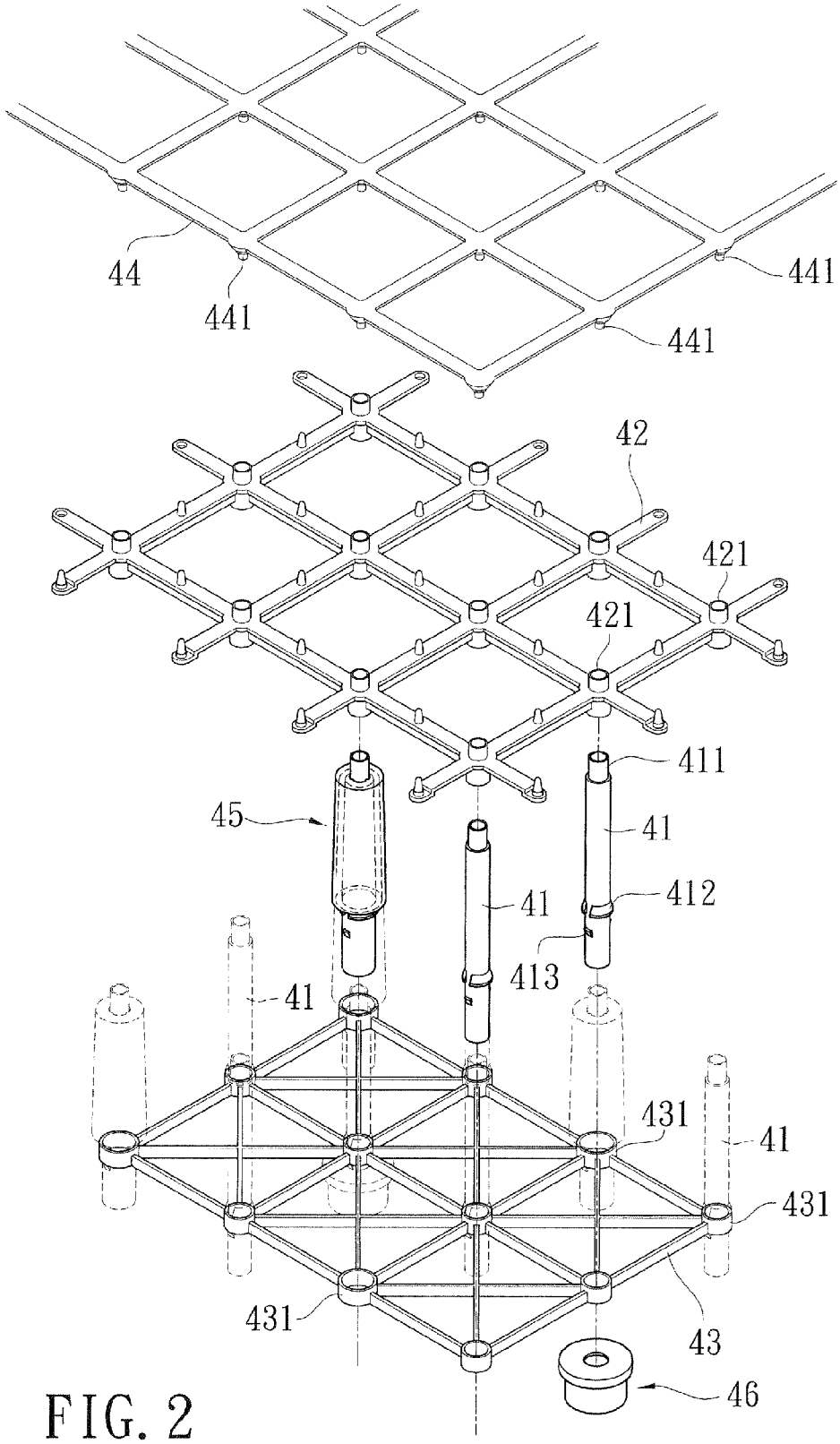
FIG. 2 is an exploded view of water draining structure of a water permeable paving according to the present invention.
Figure 3:
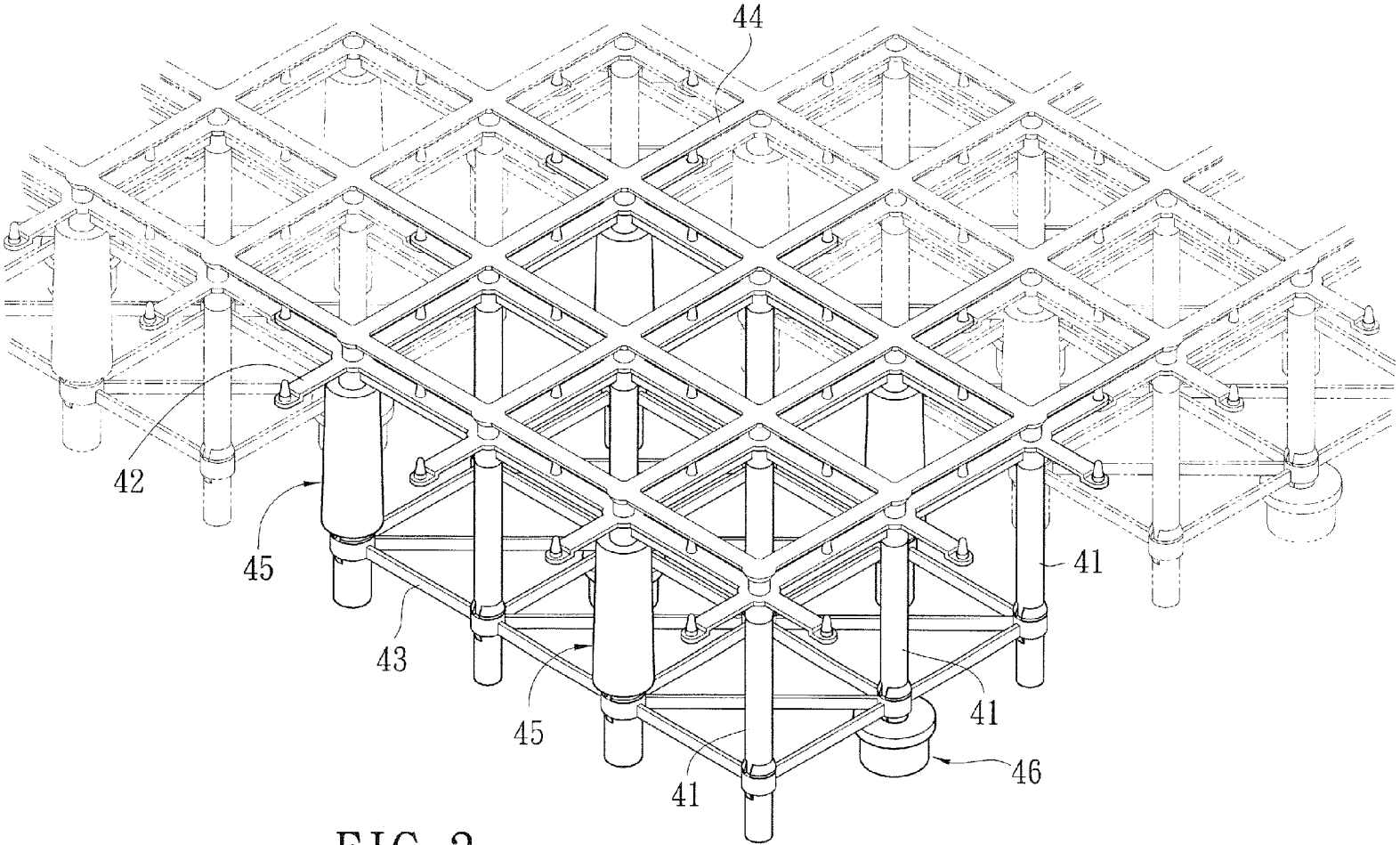
FIG. 3 is a perspective view of the water draining structure of the water permeable paving according to the present invention in an assembled form.

Referring to FIGS. 2 and 3, the water permeable paving layer 40 (as shown in FIG. 1) comprises a framework composed of a plurality of drainpipes 41 for draining water, an upper connection frame 42, a lower connection frame 43, a sealing lid moldboard 44, condensation pipes 45 having a function of air storage, and a water reservoir 46. The condensation pipe 45 provides a function of air storage and preservation, whereby in case of large area flooding, a survival space that provides air to underground microorganisms is kept. Each of the drainpipes 41 has a top end portion forming a diameter-reduced section 411 and a bottom end portion forming a retention ring 412 and a retention wedge 413 (see FIG. 4). The diameter-reduced section 411 on the top end of the drainpipe 41 can be directly fit into a barrel 421 formed on the upper connection frame 42, while the lower end of the drainpipe can be fit into a collar 431 formed on the lower connection frame 43 to allow the collar 431 received and retained between the retention ring 412 and retention wedge 413. The drainpipes 41 are hollow member. During pouring of cement slurry or grout, to securely retain the sealing lid moldboard 44 in position and prevent cement mixture undesirably filling into and thus blocking the drainpipes, a plurality of sealing lids 441 is formed on the undersurface of the moldboard 44 so that during the pouring of cement mixture, the sealing lids 441 that are fit into top openings of the drainpipes 41 prevent the cement mixture from filling into and thus blocking the pipes (see FIG. 3). The moldboard and the lids can then be removed after the pour cement mixture cures into solid to form a concrete-constructed water permeable paving layer.

Figure 4:
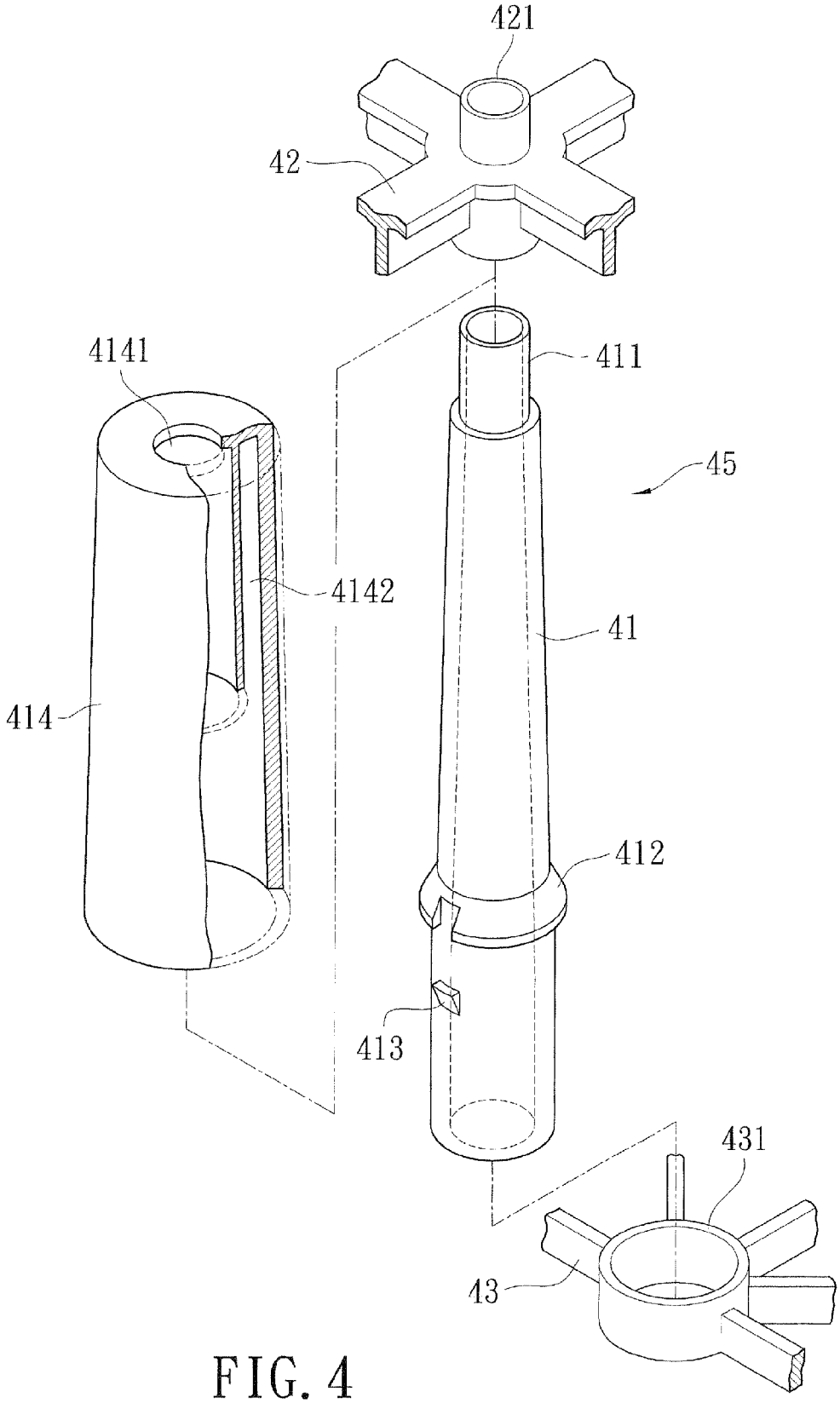
FIG. 4 is an exploded view of a drainpipe capable of air storage according to the present invention.

Referring to FIG. 4, the condensation pipe 45 that has air storage function is constructed in such a way that, as shown in the embodiment illustrated in the drawings, an outer tube 414 is fit over and coupled to a drainpipe 41. The outer tube 414 has a top forming a hole 4141. The outer tube 414 forms a circumferential gap 4142 therein, so that the combination of a drainpipe 41 and an outer tube 414 forms a drainpipe structure that is capable of water draining, air ventilation, and water condensation and collection. In an alternative embodiment, the circumferential gap 4142 can be formed as being delimited by an inside surface of an outer tube and an outside surface of a drainpipe when the outer tube and the drainpipes are combined to each other.

Figure 5:
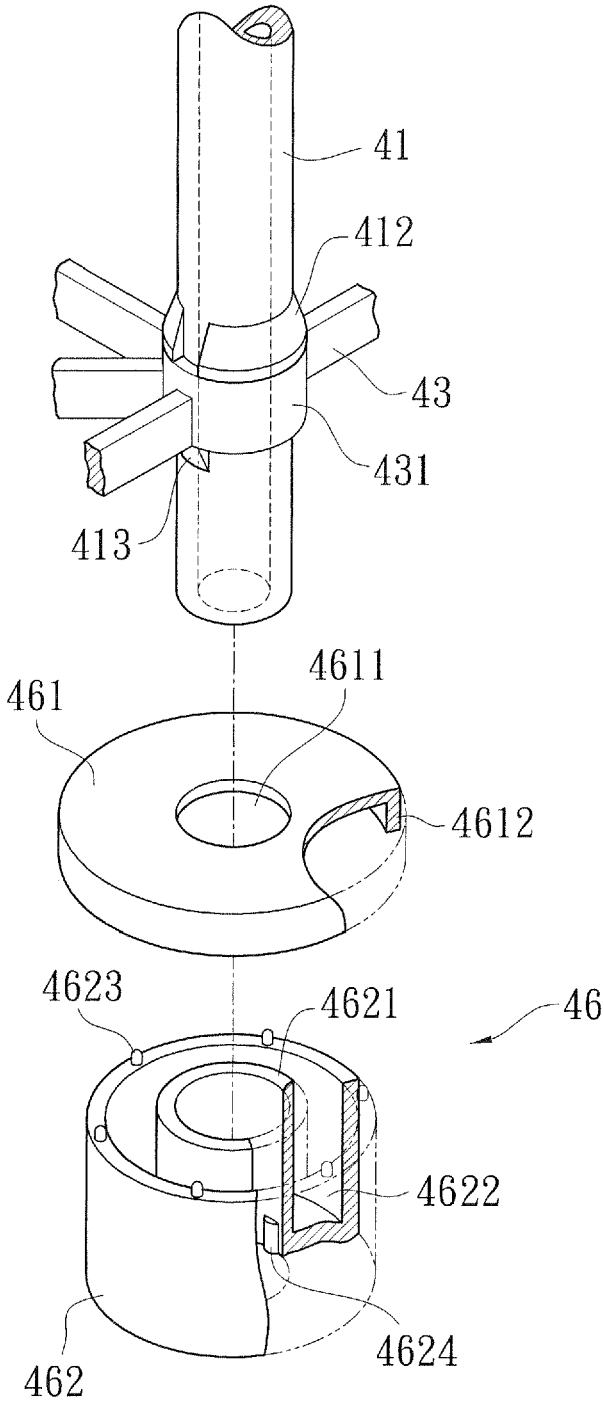
FIG. 5 is an exploded view of a water reservoir according to the present invention.

Referring to FIG. 5, the water reservoir 46 is coupled to an end, particularly the bottom end, of a drainpipe 41. Structurally, the water reservoir 46 comprises a top cover 461 and a base box 462. The top cover 461 has atop forming a hole 4611, and a rim 4612 is formed along a circumference of the top cover. The top cover 461 has an outside diameter greater than an outside diameter of the base box 462 and this helps preventing cement grout or slurry from getting into the base box during grouting or preventing sand of the drain layer from entering the base box. The base box 462 comprises a central tube 4621 and a circumferential gap 4622 around the central tube. The base box has a top forming spaced spot projections 4623. The central tube 4621 has an inside surface on which raised ribs 4624 are formed to help retaining the base box 462 when the base box is fit to the lower end of the drainpipe, so that the drainpipe 41 and the water reservoir 46 are combined together to form a structure of drainpipe that is capable of water draining, air ventilation, and water storage/preservation. The spot projections 4623 function to provide a gap for water inlet passage between the top cover 461 and the base box 462 when they are fit to each other. In an alternative embodiment, the central tube 4621 is formed so that a top end of the central tube is located higher than the top of the outer circumferential wall of the base box 462, so that when the top cover 461 and the base box 462 are fit to each other, a gap is formed to serve as water inlet passage.

Figure 6:
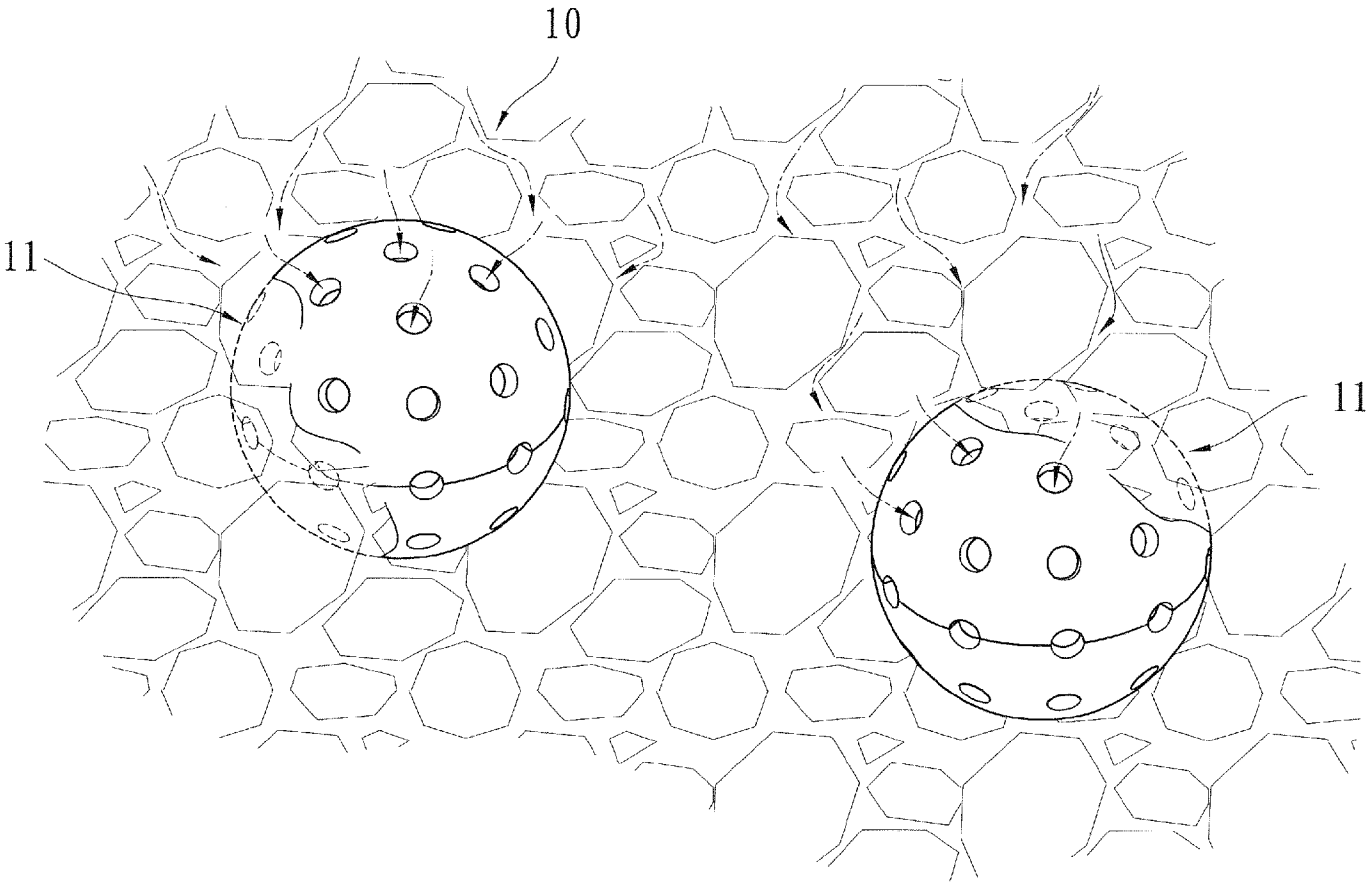
FIG. 6 is a schematic view showing a gradation layer containing hollow bodies mixed therein according to the present invention.
Figure 7:
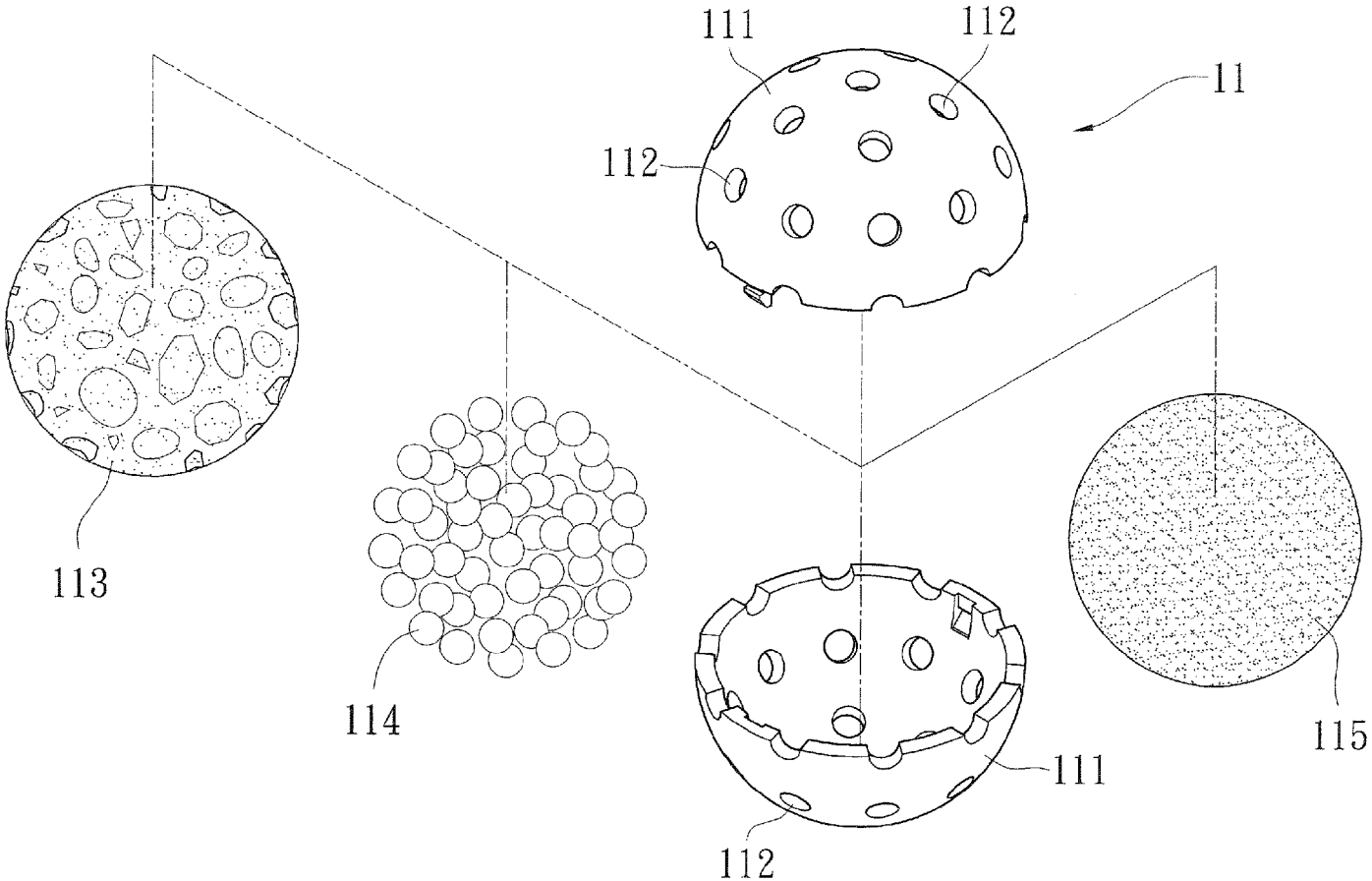
FIG. 7 is an exploded view showing various structures of hollow bodies that provide different functions according to the present invention.

Referring to FIGS. 6 and 7, the ecological gradation layer 10 is generally formed of hollow bodies 11, in combination of on-site earth, including aggregates, soils, gravels, or a mixture of water permeable concrete, and additionally and selectively comprising other gradation materials that are of no harm to the environment, such as earthenware particles. The hollow bodies 11 that show unique functions are preferably in the form of sphere, for a spherical structure is more resistant to compression stress from any direction and provide voids for the gradation layer. However, other shapes that can be readily manufactured may also be adopted. Preferably, the hollow body 11 is composed of two halves, each constituting a shell member 111, or alternatively an integrally formed unitary hollow body made with blow molding or perfusion molding. Preferably, the hollow body is made of plastics, but they can be made of other traditionally used materials. The shell members of the hollow body are made of a wall of great thickness and each shell member 111 forms a plurality of through apertures 112. The hollow bodies 11 used in the present invention can be made as engineering hollow body for different uses, such as a disaster-prevention water-storage hollow body, or an earth improvement hollow body, or a microorganism-culture hollow body or a water-keeping hollow body, or any type of hollow body that meet the need for on-site use.

The disaster-prevention water-storage hollow body, as shown in the embodiment illustrated in the drawings, comprises two shell members 111, which are combined with each other to form a hollow body that carries through apertures 112 formed therein. Thus, when the hollow bodies are mixed in the gradation layer, in case of extremely high precipitation, when the water permeable paving layer 40 needs to efficiently conduct away the rainwater, which leads to immediate saturation of water content in the gradation layer 10, water can be guided by the apertures 112 of the shells into the interior space of the hollow body, so that the chance for surface flooding in the related area can be prevented. With sufficient time lapse, penetration gradually conducts the water into the underground water stratum, and then the water received in the disaster-prevention water-storage hollow bodies is allowed to slowly release. This ensures an effect of efficient water drain for the ground surface.

The earth-improvement hollow body is constructed with two shell members 111, which are combined with each other to form an interior space in which a carbon-contained substance 113, such as active carbon or binchotan, or an earth-improvement agent desired for improvement of local earth, is filled, whereby when the earth-improvement hollow bodies are mixed in the gradation layer, the carbon-contained substance 113 functions to absorb and activate acidifying substance or harmful substance entraining water that penetrates downward and passes through the earth-improvement hollow bodies or that contained in the surrounding soil, so as to realize improvement of earth quality.

The microorganism-culture hollow body is composed of two shell members 111, which are combined to form an interior in which selected microbial strains 114 are deposited to serve as an excellent culture site for a large quantity of microorganisms. With the microorganism-culture hollow bodies mixed in the gradation layer, microorganisms can be effectively cultured and an improved environment for propagation is provided. The microorganisms so cultured can help decomposing organic substance contained in the soil, prompting nitrification, performing de-nitrification, and improving ecological environment of earth.

The water-keeping hollow body is composed of two shell members 111, which are combined to form an interior in which a water absorption substance 115 is filled, such as sponge or other water absorptive material that are not decomposable by microorganisms, so that when the water-keeping hollow bodies are mixed in the gradation layer, the water absorption substance 115 helps to absorb water when water flows through the hollow bodies so as to keep water from flowing away from the earth that ensures sufficient supply for survival and propagation of microorganisms and also improving water preservation and increasing water content in dry area. In case of high temperature on the ground surface, the high content of water in the earth allows water to be converted into vapor that is then released to the environment for heat exchange with the environment so that the heat island effect can be eliminated or alleviated.

Figure 8:
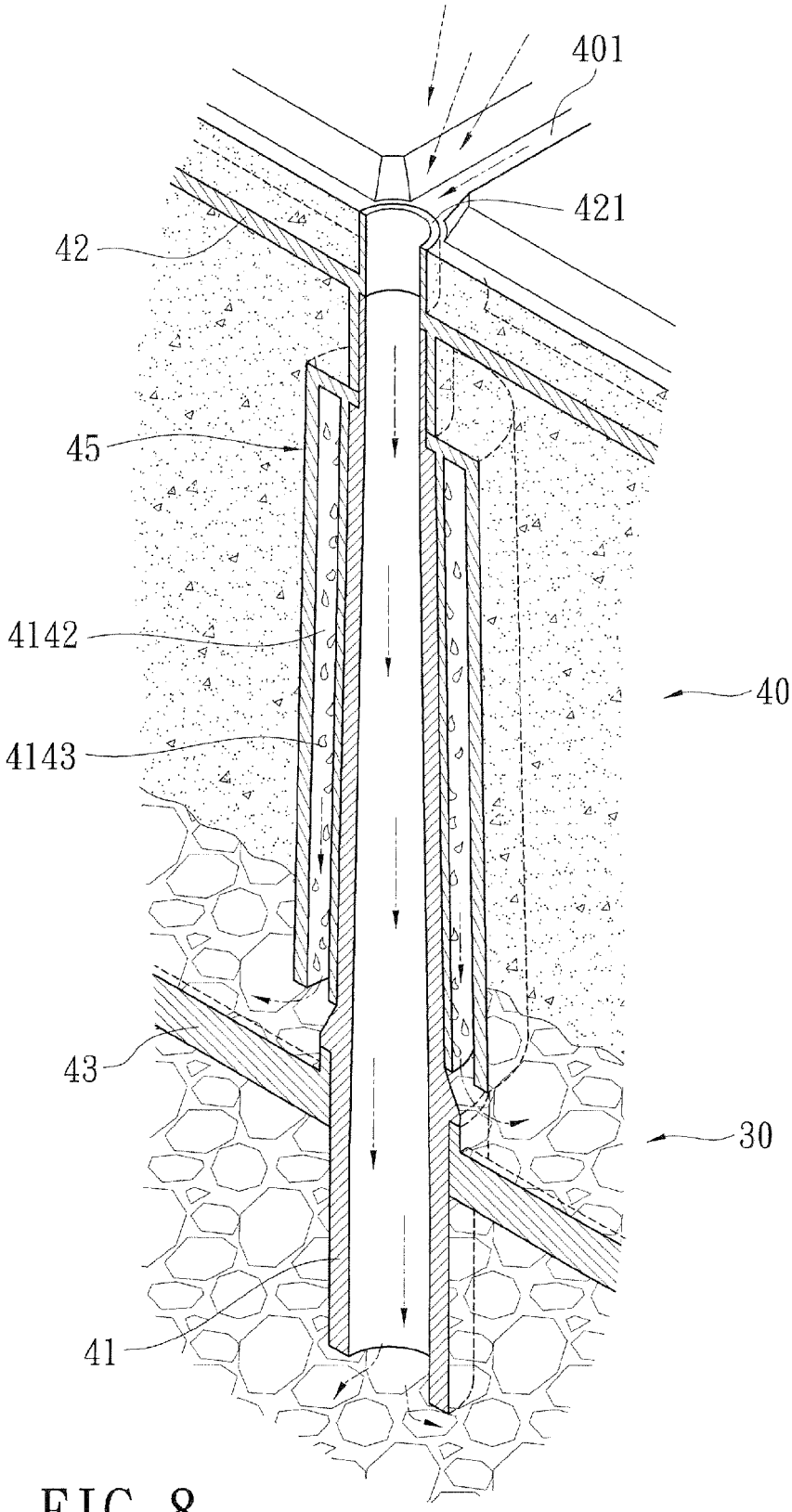
FIG. 8 is a cross-sectional view showing a draining and condensation pipe contained in water permeable paving according to the present invention.

Referring to FIG. 8, the water permeable paving layer 40 comprises, in structure thereof, a plurality of condensation pipes 45 having air storage function, and an upper connection frame 42 and a lower connection frame 43 respectively attached to top and bottom ends of the condensation pipes. Each condensation pipe 45 forms therein a circumferential gap 4142. In a cold zone, when the surrounding temperature is low, vapor or humid from the underground drain layer 30 of which the soil has a temperature higher than the surrounding temperature above the ground surface may be converted into condensed water 4143 on the wall surfaces of the circumferential gap 4142, so that water can be extracted from the atmosphere to realize natural replenishment of soil water. In case of precipitation, rainwater that falls on the surface paving layer is guided by water conduction grooves 401 into the barrel 421, flowing downward into the drainpipe 41, and entering the drain layer 30, so that water can be effectively collected, avoiding the water directly flowing along sewage system to the oceans, which represents a waste of water resources. Further, in case of extremely heavy precipitation that leads to flooding, the condensation pipe 45 having water storage function, due to a closed top end of the circumferential gap 4142, forms an enclosed air storage, whereby an emergency shelter is provided for preservation and supply of air to microorganisms or earth protozoa, which, in a flooded area, can survive from drowning by taking the air preserved in the shelter The survival of microorganisms or protozoa can ensure quick recovery in a short period and also offer helps to organic substance contained in the soil.

Figure 9:
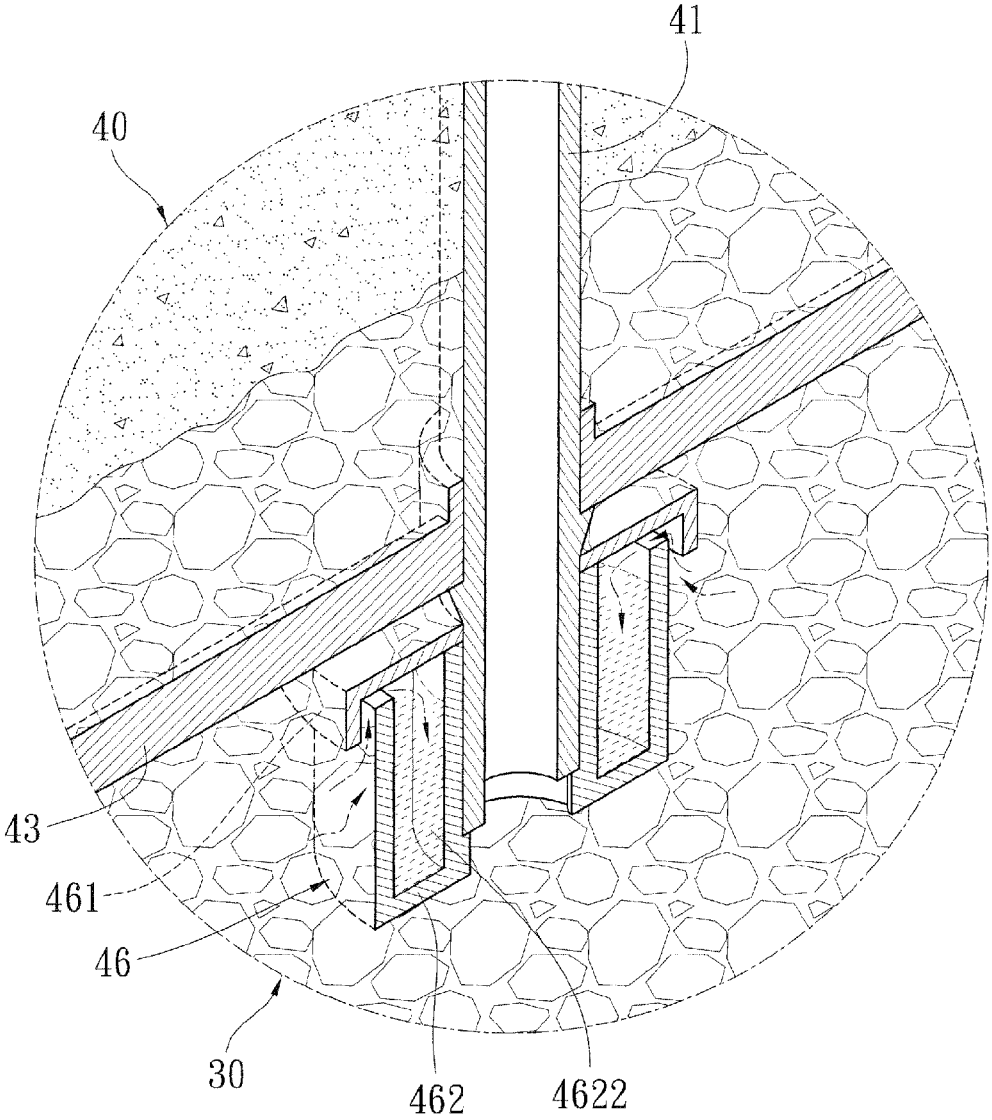
FIG. 9 is a cross-sectional view showing a water draining and water storage pipe contained in water permeable paving according to the present invention.

Referring to FIGS. 3, 5, and 9, the water permeable paving layer 40 comprises, structurally, a plurality of water reservoirs 46 which function to store and accumulate water therein, and drainpipes 41 fixed between an upper connection frame 42 and a lower connection frame 43 for draining water. At least one or each of the drainpipes 41 has a bottom end to which each water reservoir 46 is attached (see FIG. 3). The water reservoir 46 is composed of a top cover 461 and a base box 462. The base box has a central tube 4621 having a top end that is located higher position or spaced spot projections 4623 are provided (see FIGS. 5 and 9), so as to form a water inlet passage. When the drain layer 30 get saturated with water, water that penetrates downward is guided through the air inlet passage into a circumferential gap 4622 formed in the water reservoir to be accumulated and stored therein. Such stored water ensures water supply for microorganisms or protozoa inhabiting in the surrounding earth in case of draught for the survival of these microorganisms and protozoa. This also effects regulation of the underground water temperature and humidity to maintain living of plants and also to prevent desertification.

Figure 10:
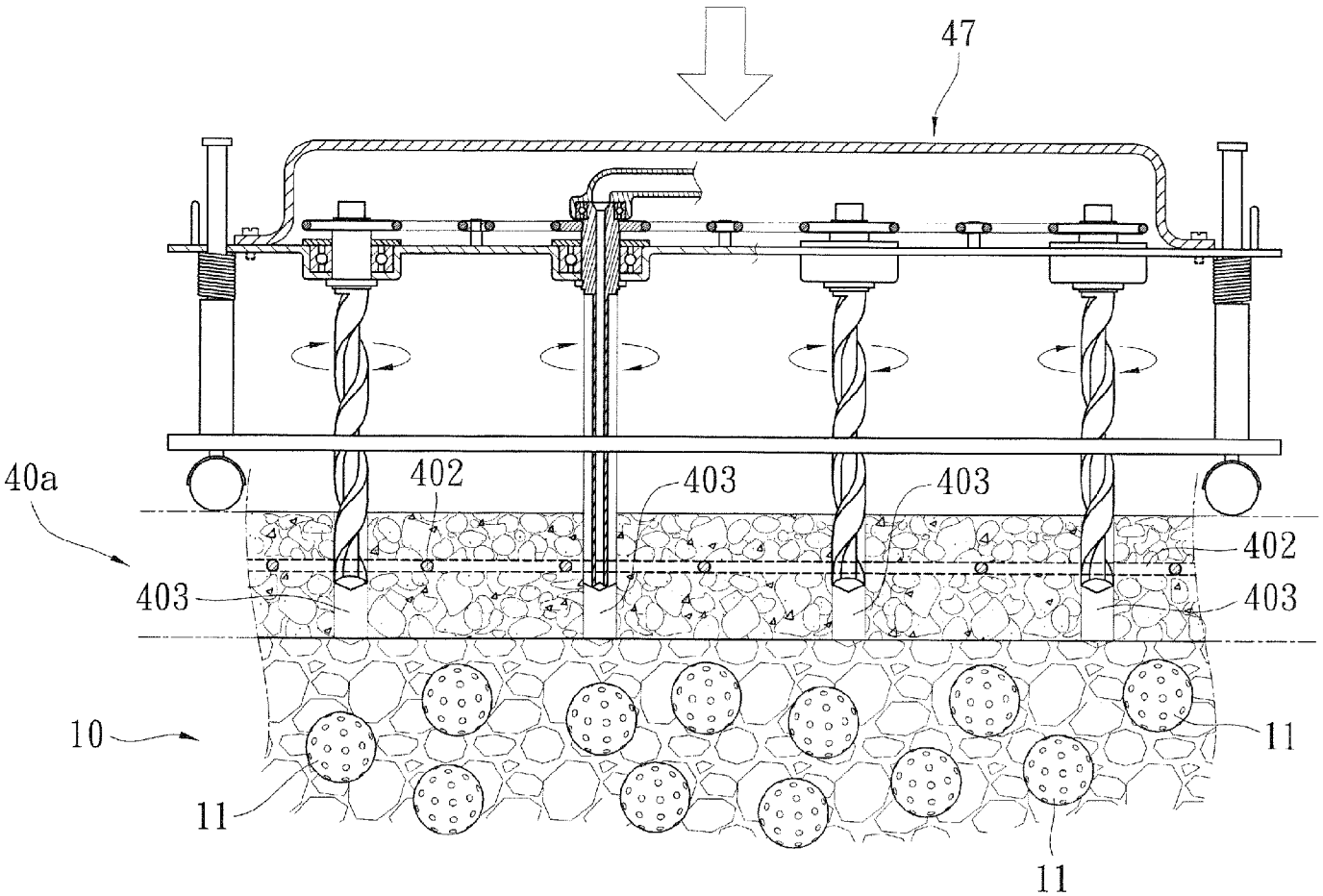
FIG. 10 is a cross-sectional view showing another embodiment according to the present invention in which drain holes is drilled in concrete paving.
Figure 11:
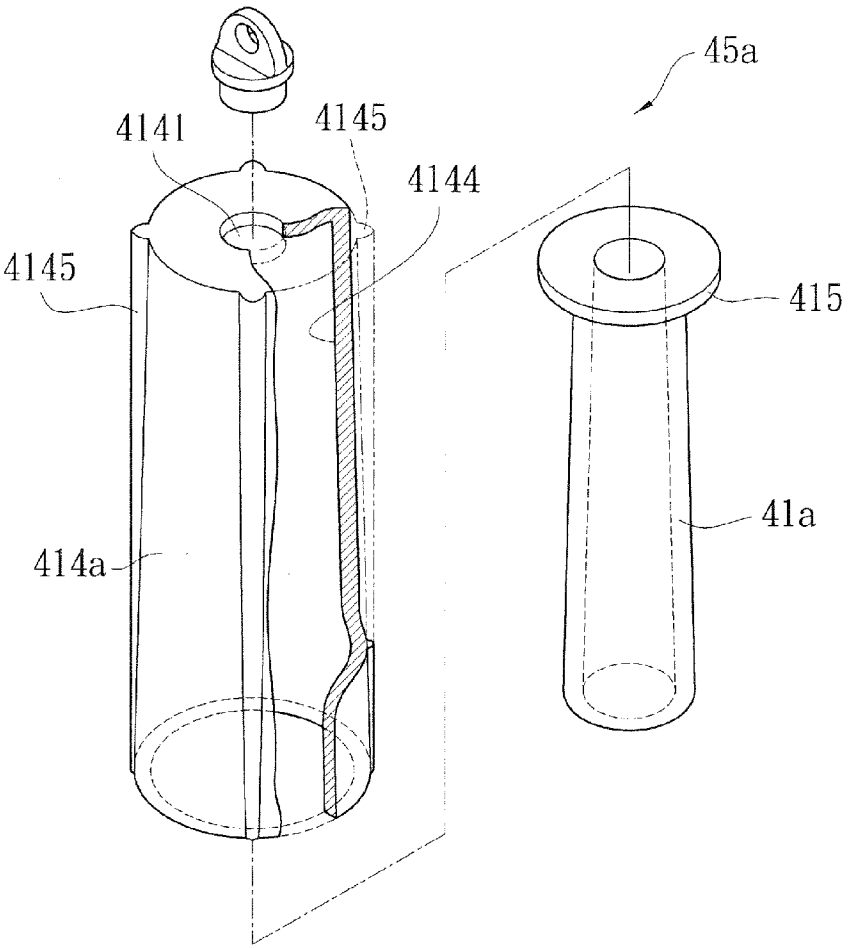
FIG. 11 is an exploded view of a condensation pipe capable of water draining and air storage according to another embodiment of the present invention.
Figure 14:
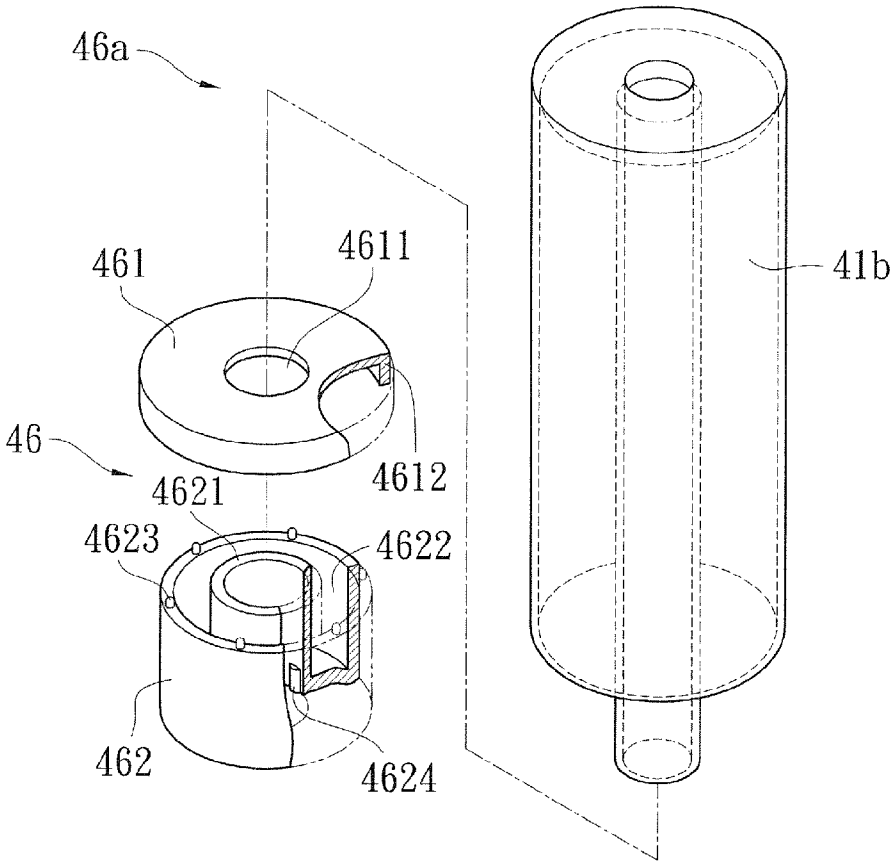
FIG. 14 is an exploded view of a water storage pipe capable of water draining and water storage according to another embodiment of the present invention.

Referring to FIGS. 10, 11, and 14, another embodiment of the present invention is illustrated, wherein the water permeable paving layer is constructed in such a way that after leveling of ground and setting of an ecological gradation layer 10, a paving layer 40*a* is formed on the ecological gradation layer 10. Preferably, the paving layer 40*a* comprises reinforcement bars 402 and the reinforcement bars 402 are arranged in a tessellate form or added with other reinforcement materials. Cement grout is then poured over the reinforcement and a rigid concrete paving is formed after the grout cures. Alternatively, the paving layer 40*a* is not formed of concrete and reinforcement, and instead the paving layer is made of asphalt. Hole drilling tools 47 are then used to form a plurality of drain holes 403 in the rigid paving surface. Condensation pipes 45*a* capable of water draining and air storage (see FIG. 11) or water storage pipes 46*a* capable of water draining and water storage (see FIG. 14), which are made in the form of individual pipes, are used in combination or individually according to the environment of the construction site. At least one of these two pipes are selected and fit into the drain holes 403 that are formed in advance. In this way, an artificial paving that helps improving global warming is similarly realized.

Figure 12:
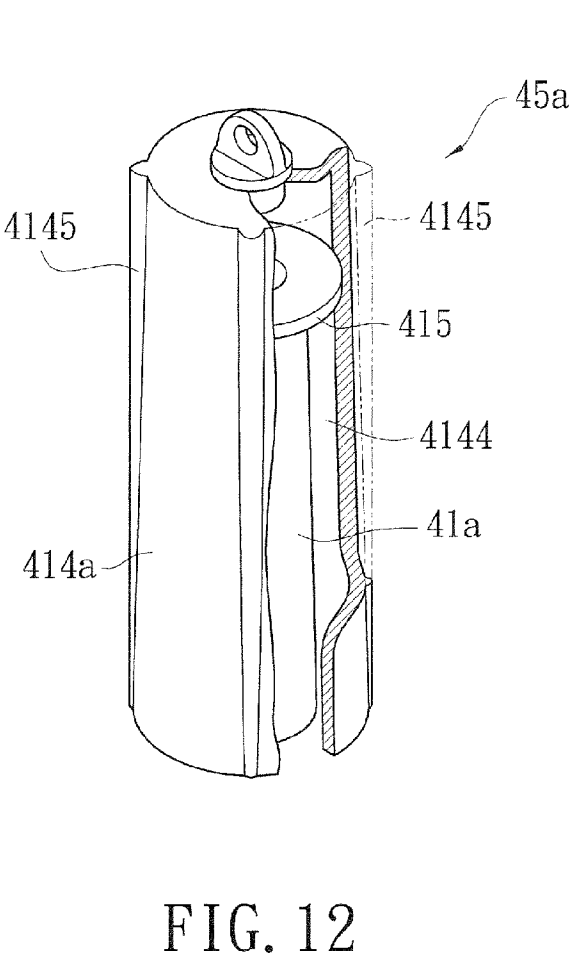
FIG. 12 is perspective view of the pipe FIG. 11 in an assembled form.
Figure 13:
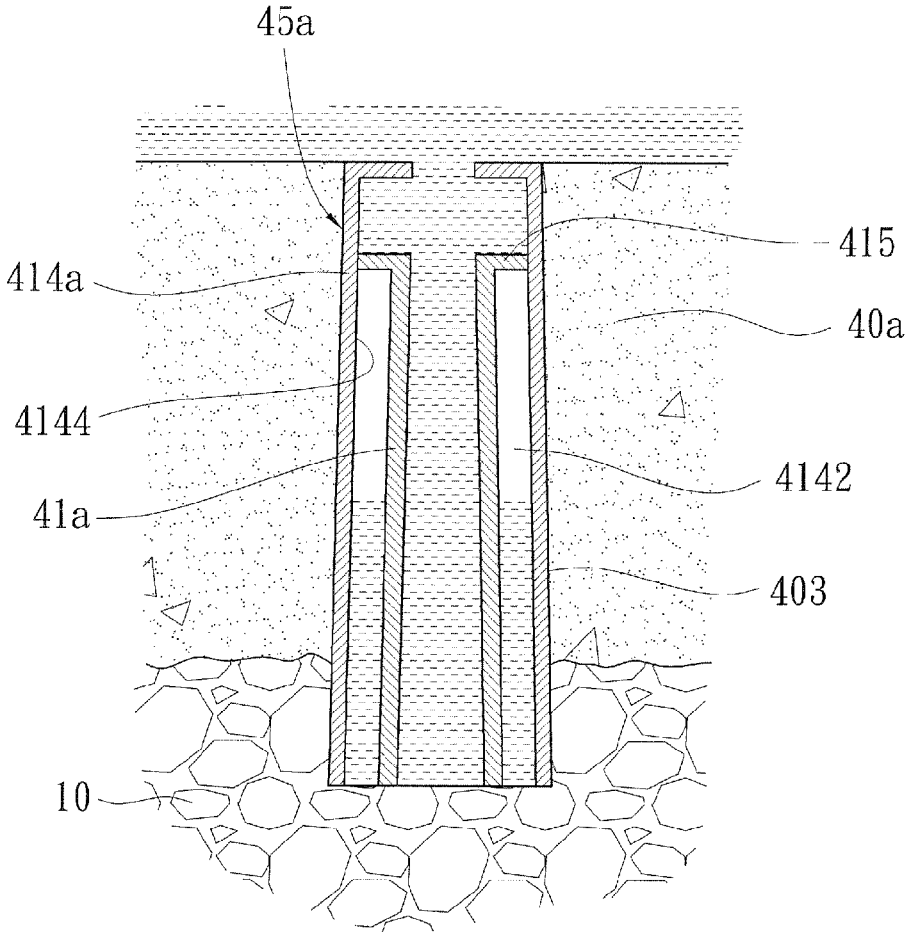
FIG. 13 is a cross-sectional view showing the pipe of FIG. 11 embedded in concrete paving according to the present invention.

Referring to FIGS. 11, 12, and 13, the condensation pipe 45*a* capable of water draining and air storage in the form of individual pipe shown in FIG. 10 comprises, structurally, an inner tube 41*a* and an outer tube 414*a*. The inner tube 41*a* is a hollow tube having a top forming a diameter-expanded circumferential flange 415. The outer tube 414*a* has a top forming a hole 4141. The outer tube 414*a* has an inside wall forming a sloped inside surface 4144. The outer tube 414*a* has an outside wall forming raised structures 4145. With the condensation pipes 45*a* properly fit into the drain holes 403 formed in the paving layer 40*a* (as shown in FIG. 13), the paving layer 40*a* forms a water permeable paving layer. When the paving layer 40*a* that allows for water permeation is flooded, the ecological gradation layer 10 is completely saturated with water and the excessive water is guided into the circumferential gap 4142 (see FIG. 13). However, an amount of air is preserved in the top portion of the circumferential gap so that a space for breathing and survival is provided for microorganisms and protozoa inhabiting in the surrounding earth in case of flooding. Also, the wall surfaces of the circumferential gap between the outer tube 414*a* and the inner tube 41*a* may constitute a structure for water condensation.

Figure 15:
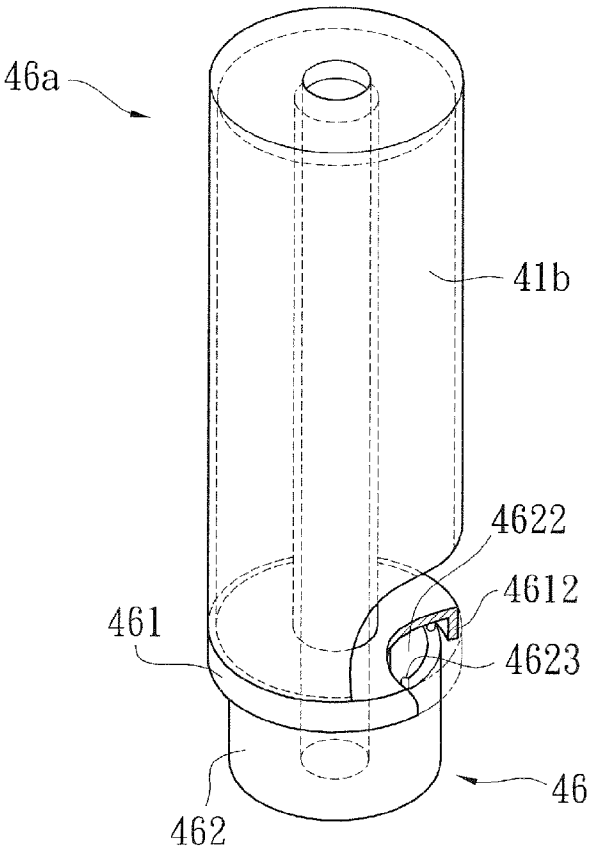
FIG. 15 is a perspective view of the pipe of FIG. 14 in an assemble form.
Figure 16:
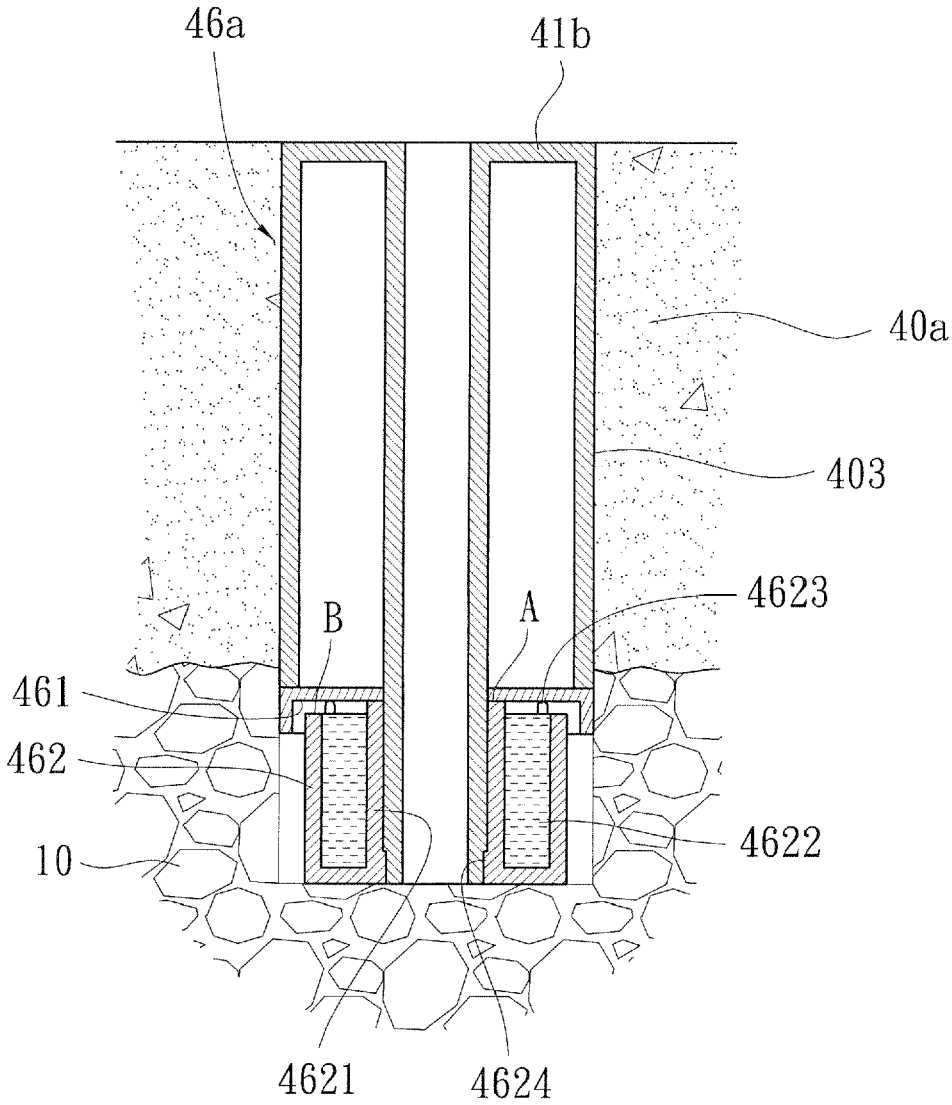
FIG. 16 is a cross-sectional view showing the pipe of FIG. 14 embedded in concrete paving according the present invention.

Referring to FIGS. 14, 15, and 16, the water storage pipe 46*a* capable of water draining and water storage in the form of individual pipe shown in FIG. 10 comprises, structurally, a water drain tube 41*b* to which a water reservoir 46 is attached. The water reservoir 46 is composed of a top cover 461 and a base box 462. The top cover 461 has a top forming a hole 4611, and a rim 4612 is formed along a circumference of the top cover. The top cover 461 has an outside diameter greater than an outside diameter of the base box 462. The base box 462 comprises a central tube 4621 and a circumferential gap 4622 around the central tube. Preferably, the base box has a top forming spaced spot projections 4623. The central tube 4621 has an inside surface on which raised ribs 4624 are formed to help retaining the base box with interference fitting realized by the raised ribs 4624 when the base box 462 is fit to an end of water drain tube 41*b*, so that the water drain tube 41*b* and the water reservoir 46 can be combined together to form a water storage pipe 46*a* that is capable of both water draining and water storage. In the embodiment illustrated, the top of the base box 462 is provided with the spot projections 4623 in order to form a water inlet passage. In an alternative embodiment, the central tube 4621 is arranged to have a top A thereof located higher than a top B of an outer wall of the base box 462 (see FIG. 16), so that a water inlet passage can be formed between the top cover 461 and the base box 462 when they are fit to each other.

As illustrated in the embodiment of FIG. 16, when the water storage pipe 46*a* is fit in a drain hole 403 that is previously formed in the paving layer 40*a* (see FIG. 16), the paving layer 40*a* is constructed as a water permeable paving layer. Rainwater falling on the paving layer 40*a* that allows for water permeation is conducted to the underside ecological gradation layer 10, and once the underside ecological gradation layer 10 get saturated with water, excessive water is guided through the water inlet passage into the circumferential gap 4622 to be accumulated and stored therein. The water so stored can serve as a water supply for microorganisms and protozoa inhabiting in the surrounding earth in case of draught. This also effects regulation of the underground water temperature and humidity to maintain living of plants and also to prevent desertification.

If desired, an interfacing layer or a drain layer, or both, can be selectively added between the ecological gradation layer 10 and the water permeable paving layer 40*a* according to the local earth quality.

Figure 17:
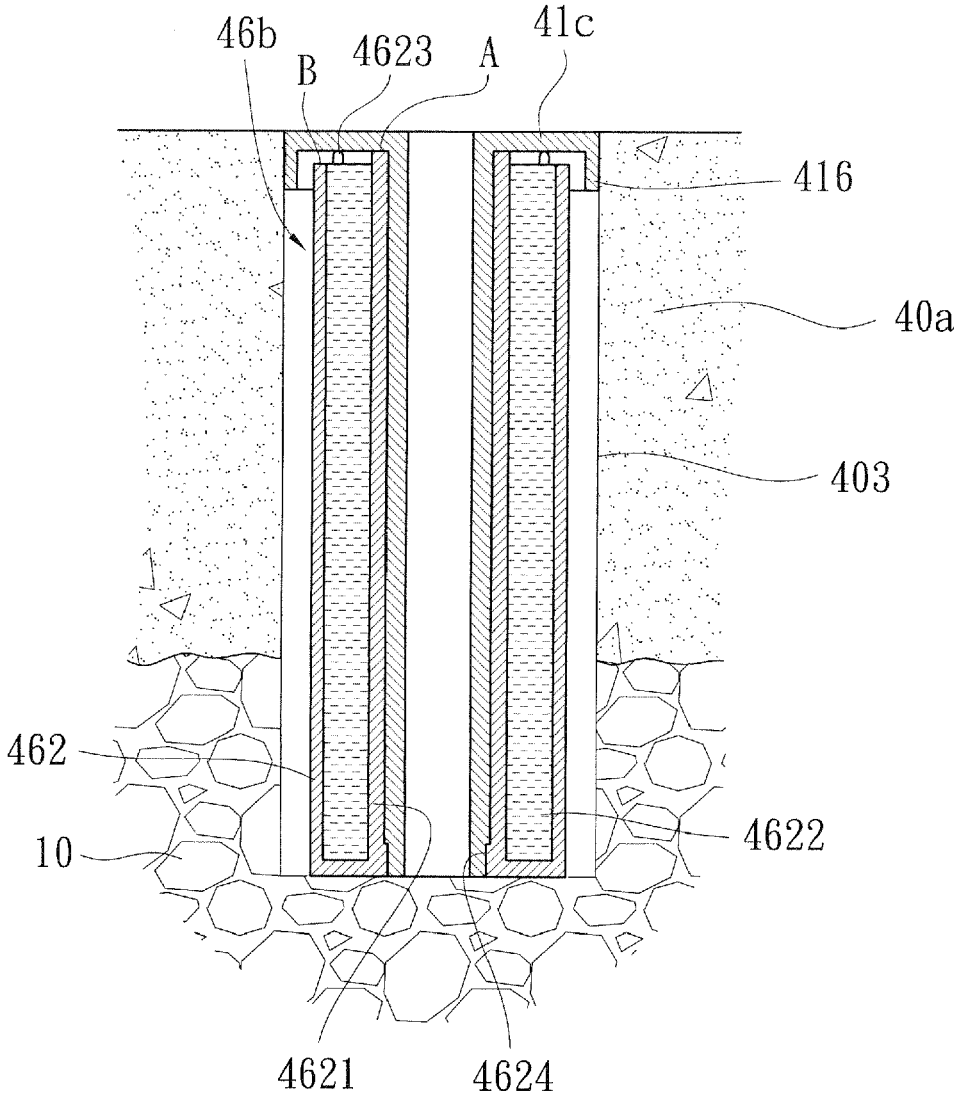
FIG. 17 is a cross-sectional view showing an alternative form of the water storage pipe of the present invention shown in FIG. 14.

Referring to FIG. 17, an alternative form of water storage pipe according to the present invention is shown, which is made in the form of an individual water storage pipe 46*b* capable of water draining and water storage. The water storage pipe 46*b* comprises, structurally, a water drain tube 41*c* and a base box 462 attached thereto. The water drain tube 41*c* has a top having an outer circumference along which a rim 416 is formed in such a way that the rim 416 has an outside diameter greater than an outside diameter of the base box 462. The base box 462 comprises a central tube 4621 and a circumferential gap 4622. Preferably, the base box has a top forming spaced spot projections 4623. The central tube 4621 has an inside surface on which raised ribs 4624 are formed to help retaining the base box with interference fitting realized by the raised ribs 4624 when the base box 462 is fit to an end of water drain tube 41*c*, so that a water storage pipe 46*b* that is capable of both water draining and water storage is provided.

In the embodiment illustrated, the top of the base box 462 is provided with the spot projections 4623 in order to form a water inlet passage. In an alternative embodiment, the central tube 4621 is arranged to have a top A thereof located higher than a top B of an outer wall of the base box 462, so that a water inlet passage can be formed between the top cover 461 and the base box 462 when they are fit to each other.

Figure 18:
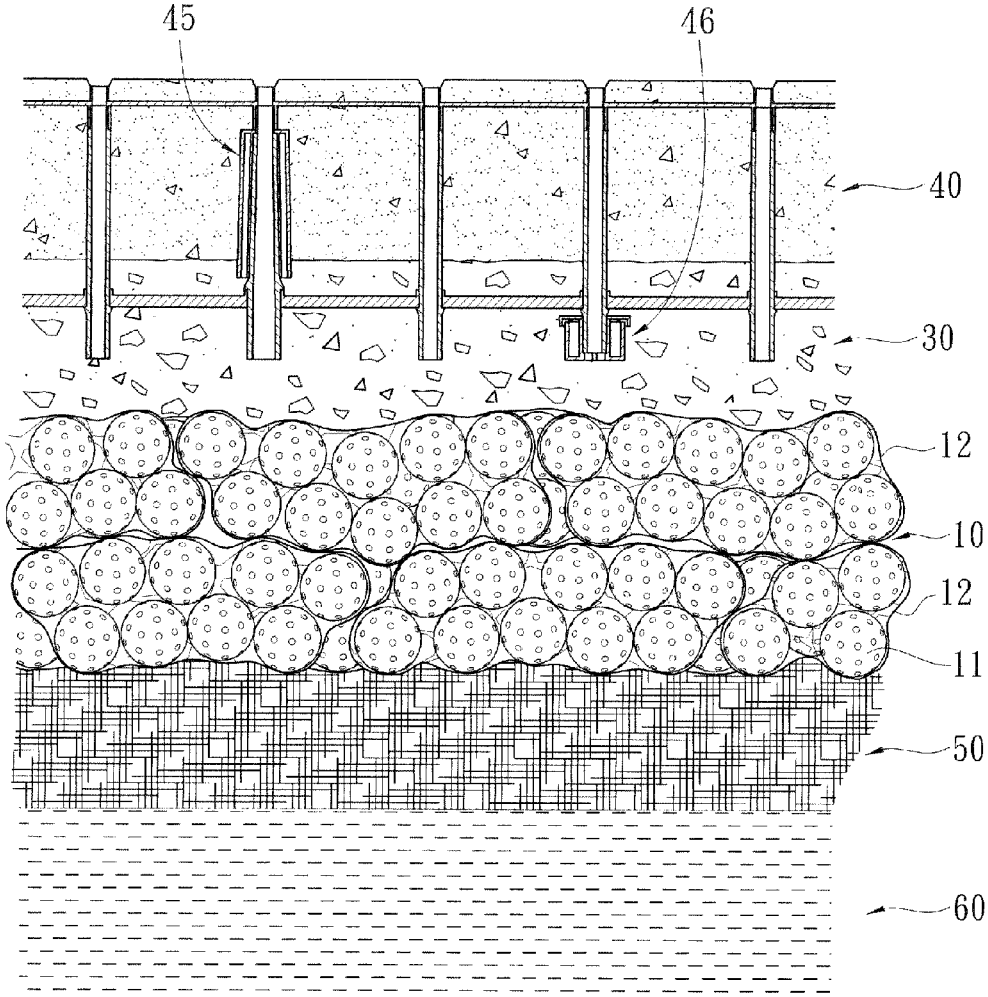
FIG. 18 is a cross-sectional view showing an ecological gradation layer according to another embodiment of the present invention.

Referring to FIG. 18, in the embodiment illustrated, the ecological gradation layer 10 can be formed of on-site earth or gradation material traditionally used for road construction, which may comprise aggregates, soils, gravels, and a mixture of concrete, and may additionally comprise other gradation materials that are of no harm to the environment. The gradation layer comprises hollow bodies 11, which unique functions. The hollow bodies 11 can be arranged in such a way that a plurality of hollow bodies are received and held in a net bag to form a bag-contained hollow body unit 12. The bag-contained hollow body units 12 can be directly laid as a gradation layer, or alternatively, the hollow body units 12 can be mixed with earth to form a gradation layer. These also provide the same effects as discussed above.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A method for manufacturing artificial paving that helps improving global warming, mainly constituted by an ecological gradation layer and a water permeable paving layer, characterized in that:

after ground leveling, an ecological gradation layer is laid first, wherein the ecological gradation layer is formed of gradation materials for road construction or on-site earth, hollow bodies being mixed in the earth, each of the hollow bodies comprising a shell composed of two halved shell members jointed to each other to define therebetween an interior space, the shell members forming through apertures communicating with the interior space, the hollow bodies and the gradation earth being mixed and laid and then subjected to pressurization for ramming; and a water permeable paving layer set on the ecological gradation;

whereby rainwater falling on ground is allowed to effectively permeate the artificially set layers to reach an underground water stratum that is located under an underground soil stratum, so that rainwater is conducted to deep location of ground to supplement the underground water stratum, and the interior space defined between the shell members of each of the hollow bodies contained in the ecological gradation layer provide an excellent survival environment for microorganisms and protozoa inhabiting in earth.

2. The method according to claim 1, wherein an interfacing layer is additionally set above the ecological gradation layer and below the water permeable paving layer.

3. The method according to claim 1, wherein a drain layer is additionally set above the ecological gradation layer and below the water permeable paving layer.

4. The method according to claim 2, wherein a drain layer is set above the interfacing layer.

5. The method according to claim 1, wherein the hollow bodies are constructed as disaster-prevention water-storage hollow bodies, which comprises hollow shells forming through apertures therein, the hollow bodies being mixed in the gradation earth.

6. The method according to claim 1, wherein the hollow bodies are constructed as earth-improvement hollow bodies, which have hollow interior spaces in which a carbon-contained substance or an earth-improvement agent is deposited.

7. The method according to claim 1, wherein the hollow bodies are constructed as microorganism-culture hollow bodies, which have hollow interior spaces in which microbial strains are set.

8. The method according to claim 1, wherein the hollow bodies are constructed as water-keeping hollow bodies, which have hollow interior spaces in which a water absorption substance, including sponge or a water absorptive material that is not decomposable by microorganisms, is deposited.

9. The method according to claim 2, wherein the interfacing layer comprises one of non-woven fabric, net, a layer of sand.

10. The method according to claim 3, wherein the drain layer is composed of gravels, or sand, or a combination of both, or a sand-based gradation material.

11. The method according to claim 4, wherein the drain layer is composed of gravels, or sand, or a combination of both, or a sand-based gradation material.

12. The method according to claim 1, wherein the water permeable paving layer comprises a plurality of drainpipes, an upper connection frame, a lower connection frame, and condensation pipes having a function of air storage, each of the condensation pipe comprising an outer tube mounted to the drainpipe, the outer tube having a top forming a hole, the outer tube forming a circumferential gap therein, so that a combination of the drainpipe and the outer tube forms a drainpipe structure that is capable of water draining and collection of condensed water.

13. The method according to claim 1, wherein the water permeable paving layer comprises a plurality of drainpipes, an upper connection frame, a lower connection frame, and water reservoirs, each of the water reservoir being attached to an end of one drainpipe, each of the water reservoirs comprising a top cover and a base box, the top cover having a top forming a hole, the top cover having an outer circumference along which a rim is formed, the top cover having an outside diameter greater than an outside diameter of the base box, the base box comprising a central tube and a circumferential gap, the central tube having a top located at a high position, the base box having a top forming spaced spot projections, which form a water inlet passage when the top cover and the base box are fit to each other, the central tube having an inside surface forming raised ribs, whereby the drainpipe and the water reservoir are combined together to form a drainpipe structure capable of water draining and water storage.

14. A method for manufacturing artificial paving that helps improving global warming, mainly constituted by an ecological gradation layer and a water permeable paving layer, characterized in that:

after ground leveling, an ecological gradation layer is laid first, wherein the ecological gradation layer is formed of gradation materials for road construction or on-site earth, hollow bodies being mixed in the earth, each of the hollow bodies comprising a shell composed of two halved shell members jointed to each other to define therebetween an interior space, the shell members forming through apertures communicating with the interior space, the hollow bodies and the gradation earth being mixed and laid and then subjected to pressurization for ramming; and a paving layer set on the ecological gradation layer, the paving layer forming a plurality of drain holes through use of hole drilling tools;

condensation pipes having functions of water draining and air storage being fit in the drain holes, so as to make the paving layer a water-draining paving layer;

whereby rainwater falling on ground is allowed to effectively permeate the artificially set layers to reach an underground water stratum that is located under an underground soil stratum, so that rainwater is conducted to deep location of ground to supplement the underground water stratum, and the ecological gradation layer provides an excellent survival environment for microorganisms and protozoa inhabiting in earth.

15. The method according to claim 14, wherein the paving layer is made cured concrete grout to form rigid paving.

16. The method according to claim 14, wherein the paving layer comprises asphalt paving.

17. The method according to claim 14, wherein the condensation pipes are replaced by water storage pipes capable of water draining and water storage.

18. The method according to claim 14, wherein the drain holes receive condensation pipes capable of water draining and air storage and water storage pipes capable of water draining and water storage therein.

19. The method according to claim 14, wherein each of the condensation pipes capable of water draining and air storage comprises an inner tube and an outer tube, the inner tube being a hollow tube having a top forming a diameter-expanded circumferential flange, the outer tube having a top forming a hole, the outer tube having an inside wall forming a sloped inside surface, the outer tube having an outside wall forming raised structures.

20. The method according to claim 17, wherein each of the water storage pipes capable of water draining and water storage comprises a water drain tube to which a water reservoir is attached, the water reservoir comprising a top cover and a base box, the top cover having a top forming a hole, the top cover having an outer circumference along which a rim is formed, the top cover having an outside diameter greater than an outside diameter of the base box, the base box comprising a central tube and a circumferential gap, the top cover and the base box forming a water inlet passage therebetween when combined.

21. The method according to claim 17, wherein each of the water storage pipes capable of water draining and water storage comprises a water drain tube and a base box attached thereto, the water drain tube having a top having an outer circumference along which a rim is formed so that the rim has an outside diameter greater than an outside diameter of the base box, the base box comprising a central tube and a circumferential gap, a water inlet passage being formed between a top end of the base box and the water drain tube.

22. The method according to claim 14, wherein an interfacing layer is set above the ecological gradation layer and below the water permeable paving layer.

23. The method according to claim 14, wherein a drain layer is set above the ecological gradation layer and below the water permeable paving layer.

24. The method according to claim 22, wherein a drain layer is set above the interfacing layer.

* * * * *